US005137466A

United States Patent [19]

Endo et al.

[11] Patent Number: 5,137,466

[45] Date of Patent: Aug. 11, 1992

[54] ELECTRIC CONNECTOR

[75] Inventors: Takayoshi Endo; Sakai Yagi; Tamio Watanabe; Masanori Tsuji, all of Shizuoka, Japan

[73] Assignee: Yazaki Corporation, Tokyo, Japan

[21] Appl. No.: 781,800

[22] Filed: Oct. 28, 1991

[30] Foreign Application Priority Data

Oct. 29, 1990 [JP] Japan ..... 2-288298

[51] Int. Cl.[5] ..... H01R 13/629

[52] U.S. Cl. ..... 439/357; 439/353

[58] Field of Search ..... 439/350, 352, 353, 357

[56] References Cited

U.S. PATENT DOCUMENTS 4,026,624 5/1977 Boag ..... 439/357
4,979,910 12/1990 Revil et al. ..... 439/357
5,055,058 10/1991 Nagasaka et al. ..... 439/353 X

FOREIGN PATENT DOCUMENTS 3-19273 2/1991 Japan .

*Primary Examiner*—Eugene F. Desmond

*Attorney, Agent, or Firm*—Nikaido, Marmelstein, Murray & Oram

[57] ABSTRACT

An electric connector wherein a pair of connector housings can be fitted smoothly with each other at a step in accordance with an inertial locking system and besides can be separated smoothly from each other. The electric connector comprises, in addition to a conventional primary locking mechanism, another locking mechanism, which includes a locking spring member mounted on one of a pair of connector housings and having a pair of contacting pieces at ends of a pair of resilient arms thereof. The second locking mechanism further includes a pair of locking spring arresting portions provided on the other connector housing on loci of the contacting pieces upon fitting or removal of the housings and each having such a diamond-shaped profile that the contacting pieces follow different routes between fitting operation and separating operation of the first and second connector housings to allow smooth fitting in accordance with an inertial locking system and smooth separation with a small force.

3 Claims, 5 Drawing Sheets

ELECTRIC CONNECTOR

BACKGROUND OF THE INVENTION

1. Field of the Invention

This invention relates to an electric connector of the type wherein a pair of female and male connector housings are fitted with each other to electrically connect female and male terminals of the housings to each other.

2. Description of the Prior Art

Electric connectors of the type wherein a pair of female and male connector housings are fitted with each other to electrically connect female and male terminals of the housings to each other normally have a locking mechanism for locking the female and male connector housings in such fitted condition. A conventional locking mechanism for an electric connector normally includes a locking arm in the form of a cantilever provided on one of the housings and an arm arresting portion provided on the other housing such that, when the two housings are fitted with each other, the locking arm is engaged with the arm arresting portion to lock the housings in the fitted condition.

Generally, such conventional locking mechanism is constructed such that a force required to insert tab portions of male terminals into terminal receiving portions is smaller than a force required to lock the locking arm and the arm arresting portion relative to each other, and accordingly, the female and male connector housings can be fitted and locked at a step by a so-called inertial locking system wherein a force at a peak of locking serves as it is as a terminal inserting force.

However, where the electric connector is designed for a high or medium current wherein tabs of male terminals have a great width and an inserting force required for each terminal is great, if the number of terminals increases, then the peak load Q by the terminals will be higher than the locking peak load P as seen from a curve K of FIG. 6. Consequently, such inertial locking system as mentioned above does not apply, but two step locking applies to such electric connector. Accordingly, such electric connector has a drawback that incomplete fitting of housings likely takes place.

SUMMARY OF THE INVENTION

It is an object of the present invention to provide an electric connector wherein a pair of connector housings can be fitted smoothly with each other at a step in accordance with an inertial locking system and besides can be separated smoothly from each other.

In order to attain the object, according to the present invention, there is provided an electric connector which comprises first and second connector housings for fitting with each other, a locking arm provided on the first connector housing, arm arresting means provided on the second connector housing for cooperating, when the first and second connector housings are fitted each other, with the locking arm to lock the first and second connector housings relative to each other, locking spring means including a pair of resilient arms mounted at base ends thereof on one of the first and second connector housings and extending obliquely in such a manner as to approach each other, the locking spring means further including a pair of contacting pieces extending from the other ends of the resilient arms and curved in such a manner as to be spaced away from each other, each of the contacting pieces having a lateral extension from an end thereof, and a pair of locking spring engaging means provided on the other of the first and second connector housings and each having a diamond-shaped profile wherein an apex between a pair of outer side inclined faces has a height considerably greater than a height of another apex between a pair of inner side inclined faces from a diagonal line interconnecting the other two apexes, the locking spring engaging means being disposed on loci of the contacting pieces of the locking spring means upon fitting or removal of the first and second connector housings with or from each other such that the diagonal lines are positioned so that, when the first and second connector housings are fitted with each other, the contacting pieces of the locking spring means are guided at the extensions thereof to and by the outer side inclined faces of the locking spring means, but when the first and second connector housings are removed from each other, the contacting pieces are guided to and by the inner side inclined faces of the locking spring means.

Thus, the electric connector comprises, in addition to such locking means including the locking arm and cooperating arresting means as in a conventional electric connector, another locking means including the locking spring means and the pair of locking spring engaging means. When the first and second connector housings are moved toward each other to fit them with each other, the locking spring engaging means are engaged with and yieldably open the resilient arms of the locking spring means so that they are admitted into the interior of the one of the first and second connector housings until the first and second connector housings are fully fitted with each other. During such fitting operation, the lateral extensions of the contacting pieces of the locking spring means are engaged with and slidably move on the outer side inclined faces of the locking spring engaging means provided at the corresponding positions. On the contrary when the first and second connector housings are to be separated from each other, the lateral extensions of the contacting pieces are engaged with the inner side inclined faces of the corresponding locking spring engaging means.

In a fitting process of the first and second connector housings, when the outer side apex portions of the locking spring engaging means are positioned forwardly of the contacting pieces of the locking spring means, a force acts in a direction to oppose such fitting of the first and second connector housings and the locking peak is high, but after the outer side apex portions move rearwardly of the contacting pieces. another force acts in the opposite direction to promote such fitting of the first and second connector housings. Accordingly, the first and second connector housings can be fitted smoothly at a step with each other in accordance with a so-called inertial locking system.

On the other hand, in a separating process of the first and second connector housings, when the inner side apex portions of the locking spring engaging means are positioned rearwardly of the contacting pieces of the locking spring means, a force acts in a direction to oppose such separation of the first and second connector housings, but such force is small because the inner side inclined faces have a comparatively small slope. Then, after the inner side apex portions move forwardly of the contacting pieces, another force acts in the opposite direction to promote such separation of the first and second connector housings. However, such force is small because the inner side inclined faces have a comparative small slope.

Since the contacting pieces of the locking spring means follow different routes between fitting operation and separating operation of the first and second connector housings in this manner, when the first and second connector housings are to be fitted with each other, they can be fitted smoothly with each other in accordance with an inertial locking system, and on the contrary when they are to be separated from each other, they can be separated smoothly with a small force.

Preferably, the locking spring means is a single spring member having a base portion secured to the one of the first and second connector housings, and the resilient arms extends from the opposite ends of the base portion. Also, the diagonal lines of the locking spring engaging means are inclined by a small angle with respect to a direction in which the first and second connector housings are inserted into or removed from each other.

The above and other objects, features and advantages of the present invention will become apparent from the following description and the appended claims, taken in conjunction with the accompanying drawings.

DESCRIPTION OF THE PREFERRED EMBODIMENT

Figure 1:
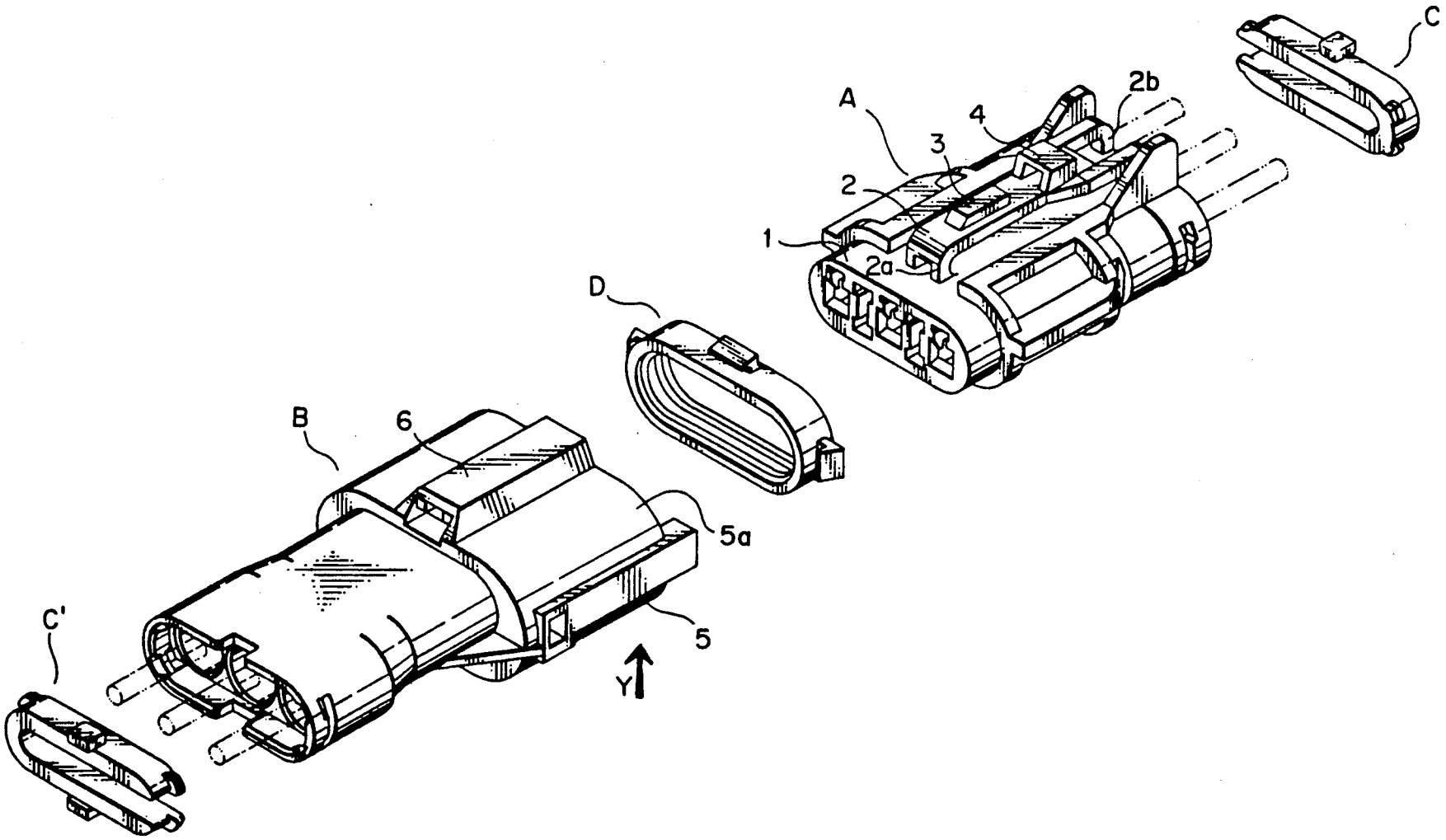
FIG. 1 is a fragmentary perspective view of an electric connector showing a preferred embodiment of the present invention.
Figure 2:
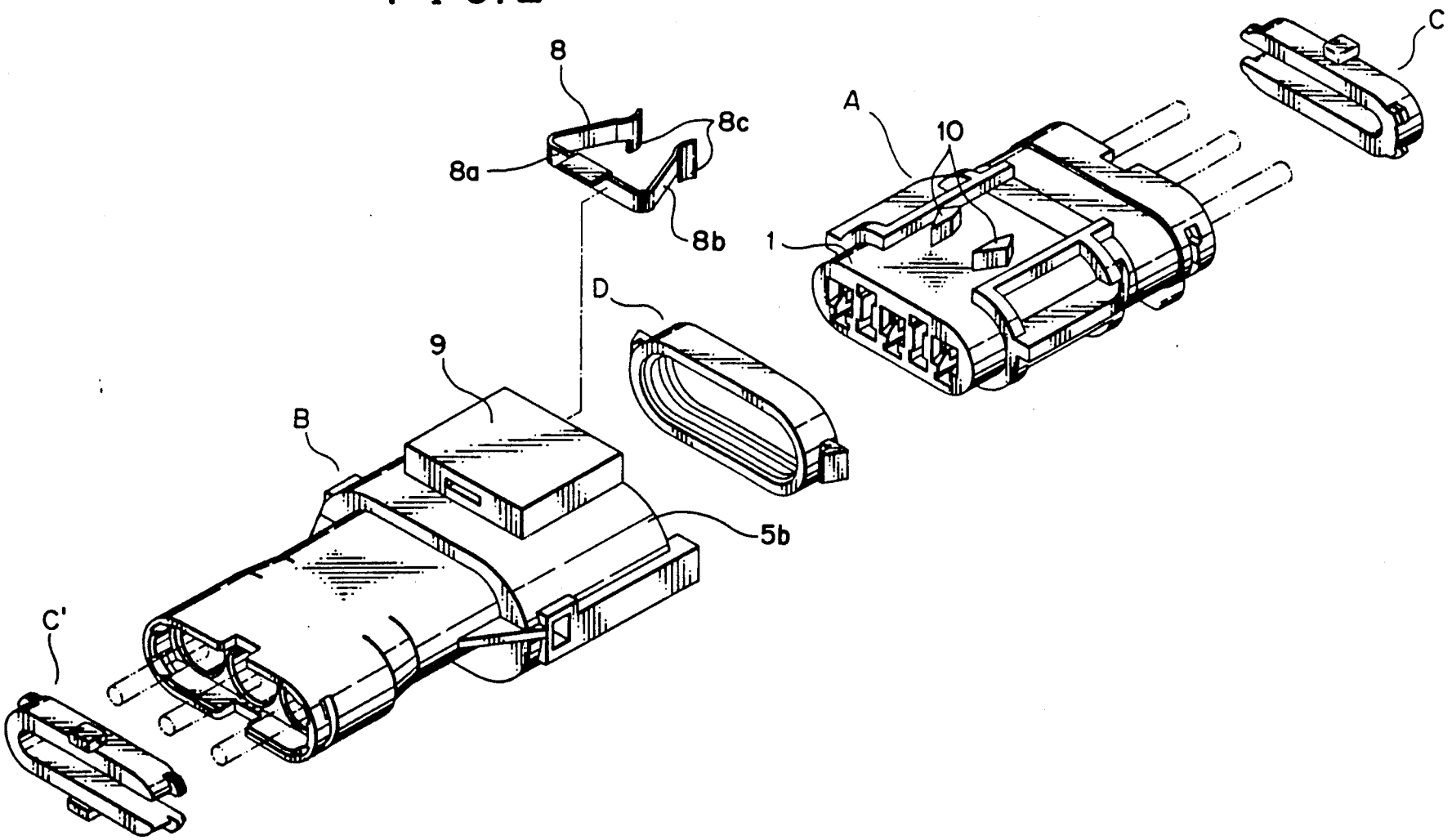
FIG. 2 is a similar view but showing female and male connector housings and a locking spring of the electric connector of FIG. 1 as viewed in a direction indicated by an arrow mark Y in FIG. 1.
Figure 3:
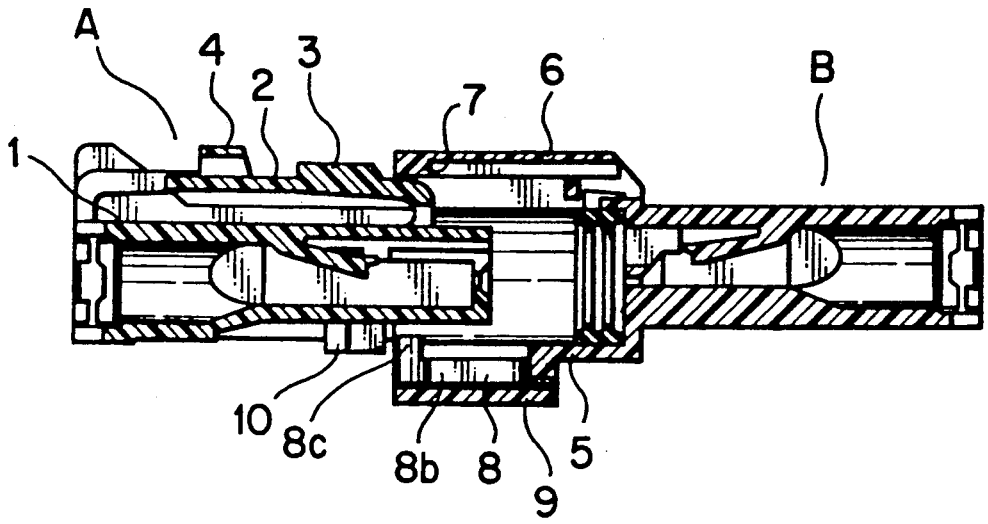
FIG. 3 is a sectional view of the electric connector of FIG. 1 at a stage immediately after starting of fitting of the female and male connector housings with each other.

Referring to FIGS. 1 to 3, there is shown an electric connector to which the present invention is applied. The electric connector shown includes a male connector housing A made of a synthetic resin, a female connector housing B similarly made of a synthetic resin, a pair of rear holders C and C' for preventing female and male terminals not shown of the male and female connector housings A and B from being pulled off the housings A and B, and a lip packing D made of synthetic rubber and fitted around a mutually fitted portion of the housings A and B so as to construct the electric connector as a water-proof electric connector.

A locking arm 2 is provided on an upper face of an outer peripheral wall 1 of the male connector housing A. The arm 2 is secured at a pair of rising base portions 2*a* and 2*b* at the opposite ends thereof to the male connector housing A and has an arresting projection 3 and an operating portion 4 provided on an upper face thereof.

The female connector housing B has a hood 5 provided at a front portion thereof for receiving the male connector housing A therein. A locking chamber 6 is formed on an upper peripheral wall 5*a* of the hood 5 such that it projects upwardly from the hood 5. The locking chamber 6 is adapted to receive the locking arm 2 of the male connector housing A therein, and an arresting portion 7 (refer to FIG. 3) is formed in the chamber 6 for engaging the arresting projection 3 of the male connector housing A.

The locking arm 2 of the male connector housing A can be resiliently displaced upwardly or downwardly in an opposing relationship to the outer peripheral wall 1 so that, when the two housings A and B are fitted with each other, the locking arm 2 is engaged with the arresting portion 7 of the locking chamber 6 of the female connector housing B primarily lock the two housings A and B relative to each other.

While such locking mechanism is already known, the electric connector of the present invention includes another locking mechanism. The latter locking mechanism includes a locking spring 8 mounted on the female connector housing B and a pair of locking spring engaging portions 10 provided on a lower face of the outer peripheral wall 1 of the male connector housing A.

The locking spring 8 is formed by bending a resilient metal plate and has a base plate portion 8*a*, a pair of resilient arms 8*b* extending laterally from the opposite eends of the base plate portion 8*a* such that forward free ends thereof approach a little toward each other and are laterally resiliently displaceable toward and away from each other, and a pair of contacting pieces 8*c* extending from the free ends of the resilient arms 8*b* in such a curved condition that they may be spaced away from each other toward the free ends thereto. Each of the contacting pieces 8*c* has a downward extension which is curved with a same curvature as the remaining portion thereof such that it may present a key-like shape in side elevation together with the resilient arm 8*b*.

The locking spring 8 is mounted in a spring chamber 9 formed on a lower peripheral wall 5*b* of the hood 5 and having a box-like profile as seen in FIG. 2.

Figure 4:
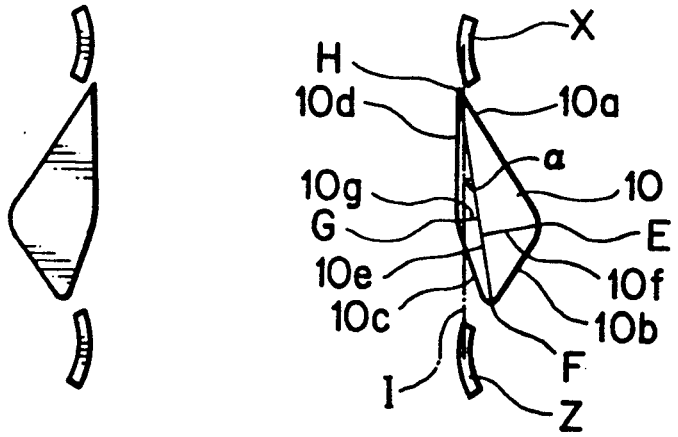
FIG. 4 is a schematic illustration at a stage of a fitting or removing process of a contacting piece and a locking spring engaging portion with or from each other.

Referring now to FIG. 4, each of the locking spring engaging portions 10 is formed as a substantially diamond-shaped projecting and has a pair of mountain-shaped inclined faces on the opposite sides thereof, including an outer side front inclinded face 10*a*, an outer side rear inclined face 10*b*, an inner side rear inclined face 10*c* and an inner side front inclined face 10*d*. A perpendicular line from an apex E between the inclined faces 10*a* and 10*b* to a diagonal line 10*e* interconnecting another apex H between the inclined faces 10*d* and 10*a* and a further apex F between the inclined faces 10*b* and 10*c* is set longer than another perpendicular line 10*g* from a still further apex G between the inclined faces 10*c* and 10*d* to the diagonal line 10*e*.

Further, each of the locking spring engaging portions 10 is constructed such that a line I interconnecting a position X and another position Z of an engaging piece 8*c* at points of time immediately before and after it is engaged with the locking spring engaging portion 10 makes a small angle $\alpha$ of attack with respect to the line 10*e*.

It is to be noted that, while the locking spring 8 described above is formed as a unitary member by bending a resilient metal plate and including the base plate portion 8a and the resilient arms 8b and contacting pieces 8c formed on the opposite sides of the base plate portion 8a, it is only required that the resilient arms 8b in pair be disposed at such respective specific positions as described above, and accordingly, they may otherwise be formed as independent elements omitting the base plate portion 8a. Further, the locking spring 8 need not necessarily be formed from a resilient metal plate but may be formed from any other resilient metal element such as, for example, a wire such as a piano wire.

Referring now to FIGS. 5a to 5i, there are shown different successive steps of a fitting and removing process of the male and female connector housings A and B with and from each other. It is to be noted that the following description of such fitting and removing operation proceeds on the assumption that, in order to facilitate understanding, the female connector housing B is fixed and the male connector housing A is advanced into and retracted from the fixed female connector housing B to effect such fitting and removing operation.

Figure 5A:
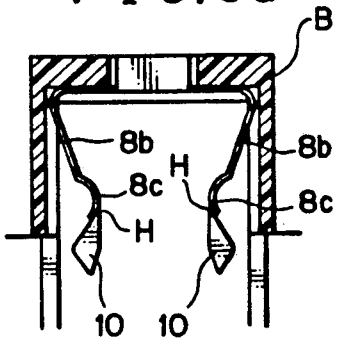
FIGS. 5*a* to 5*i* are schematic sectional views showing different steps of a fitting and removing process of the locking spring and the locking spring engaging portion of the electric connector of FIG. 1.

After the male connector housing A begins to be inserted into the female connector housing B, the apex or end portions H of the locking spring engaging portions 10 of the male connector housing A are engaged with the downward extensions of the contacting pieces of the locking spring 8 and advanced between the resilient arms 8b of the locking spring 87 under the guidance of the contacting pieces 8c as seen in FIG. 5a.

Figure 5B:
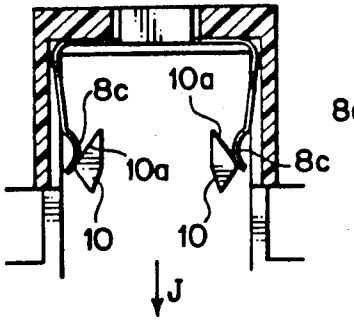
Figure 5C:
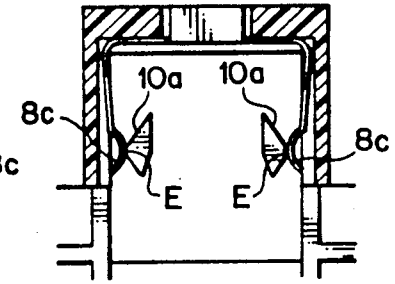

As the male connector housing A is fitted further deeply into the male connector housing B, the outer side front inclined faces 10a of the locking spring engaging portions 10 push the contacting pieces 8c of the locking spring 8 to resiliently displace the resilient arms 8b outwardly away from each other as seen in FIG. 5b until the apex portions E of the locking spring engaging portions 10, at which the locking spring engaging portions 10 present a maximum distance between them, contact with the contacting pieces 8c of the locking spring 8 as seen in FIG. 5c.

In the process of movement of the male connector housing A from the position shown in FIG. 5a to the position shown in FIG. 5c, since the locking spring engaging portions 10 are advanced into the female connector housing B while pushing the resilient arms 8b of the locking spring 8 to open laterally against a resilient repulsive force provided by the resilient arms 8b, the locking spring engaging portions 10 are acted upon by a component J of force in a direction opposite to the fitting direction from the contacting pieces 8c of the locking spring 8 on which the outer side front inclined faces 10a of the locking spring engaging portions 10 slide. In other words, the male connector housing A is acted upon by a component of force in a direction to oppose fitting thereof into the female connector housing B.

Figure 5D:
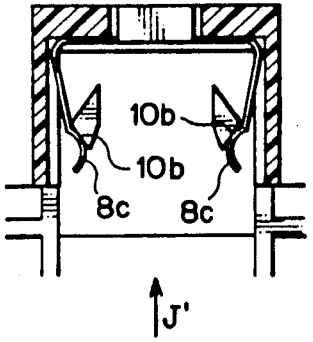

Then, when the male connector housing A is further fitted into the female connector housing B until the apex portions E of the locking spring engaging portions 10 pass the contacting pieces 8c of the locking spring 8 and come to the interior side with respect to the contacting pieces 8c as shown in FIG. 5d, the locking spring engaging portions 10 are now acted upon by a component J' of force in the fitting direction due to sliding engagement between the contact pieces 8c and the outer side rear inclined faces 10b of the locking spring engaging portions 10. Consequently, fitting of the male and female housings A and B is promoted by such component J' of force.

Figure 5E:
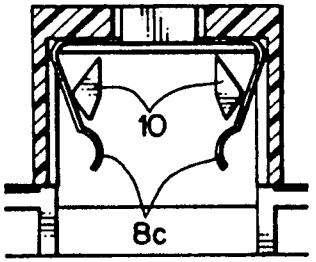

As such fitting further proceeds, the male connector housing A comes to such a position as shown in FIG. 5e in which it is fitted completely in the female connector housing B.

Figure 5F:
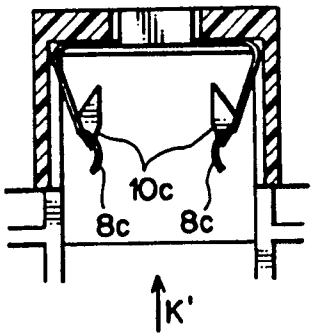

In order to remove the male connector housing A in such completely fitted condition from the female connector housing B, the male connector housing A will be pulled to retract from the female connector housing B. After starting of such retracting movement of the male connector housing A, the contacting pieces 8c of the locking spring 8 are engaged at the downward extensions thereof with and then guided by and slidably moved along the inner side rear inclined faces 10c of the locking spring engaging portions 10 as seen in FIG. 5f. However, since the slope of the inner side rear inclined faces 10c is small, also the component k' of force which is caused by sliding movement of the contacting pieces 8c of the locking spring 8 on the inclined faces 10c and acts in a direction to oppose separation of the male and female connector housings A and B from each other is small.

Figure 5G:
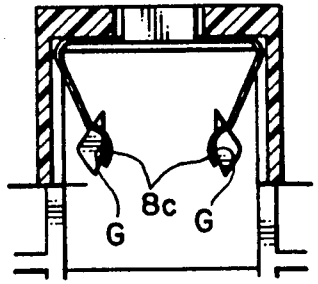
Figure 5H:
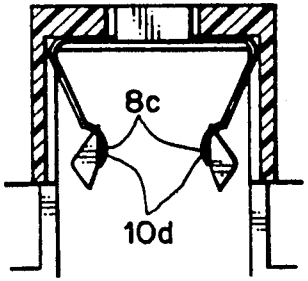
Figure 5I:
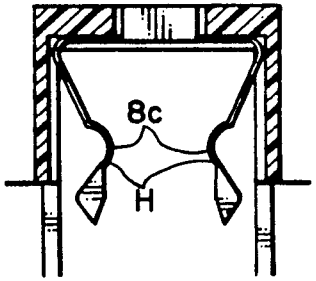

As the retracting movement further proceeds, the apex portions G of the locking spring engaging portions 10 are engaged with the contacting pieces 8c of the locking spring 8 as seen in FIG. 5g. After then, the inner side front inclined faces 10d of the locking spring engaging portions 10 are engaged with and slide on the contacting pieces of the locking spring 8 as seen in FIG. 5h. In this instance, however, since the inclined faces 10d have a very small slope, little component of force is produced in the fitting or retracting direction of the male connector housing A. Then, as the retracting movement of the male connector housing A further proceeds, the contacting pieces 8c of the locking spring 8 are disengaged from the apex portions H of the locking spring engaging portions 10 as seen from FIG. 5i.

Figure 6:
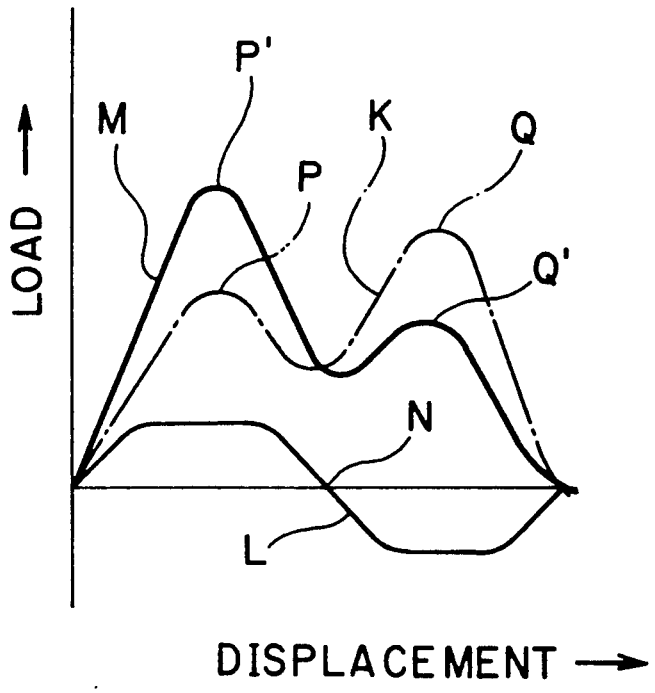
FIG. 6 is a graph illustrating a relationship between a fitting depth of female and male housings of an electric connector and a load required to fit them with each other.

Referring now to FIG. 6, there is shown a graph which illustrates a relationship between a depth in fitting female and male connector housings with each other from such position as shown in FIG. 5a to such position as shown in FIG. 5d and a load required for such fitting operation. A curve K indicates such load with an exemplary one of conventional electric connectors while another curve L indicates a locking load provided by the locking spring 8 and the locking spring engaging portions 10 of the electric connector described above, and a further curve M is a combined curve of the curves K and L and indicates a fitting load actually produced with the electric connector of the present invention. Generally, when the electric connector is to be put into a fully fitted condition, the female and male connector housings B and A first begin to be fitted with each other and then female and male terminals begin to be fitted with each other. In particular, the female and male terminals begin to be fitted with each other at a substantially middle point N of the axis of abscissa of FIG. 6 which represents a displacement between the female and male connector housings B and A, and the connector peak load P' which is caused by friction between the female and male connector housings B and A presents a very higher value than the terminal peak load Q' which is caused by such friction between the male and female housings A and B and friction between the male and female terminals. Consequently, the male and female connector housings A and B are fitted with each other in accordance with an inertial locking system.

On the other hand, production of a load caused by the locking spring upon separation of the male and female connector housings A and B and acting to oppose such separation is minimized. Accordingly, the male and female connector housings A and B can be separated smoothly from each other.

Having now fully described the invention, it will be apparent to one of ordinary skill in the art that many changes and modifications can be made thereto without departing from the spirit and scope of the invention as set forth herein.

What is claimed is:

1. An electric connector, comprising first and second connector housings for fitting with each other, a locking arm provided on said first connector housing, arm arresting means provided on said second connector housing for cooperating, when said first and second connector housings are fitted each other, with said locking arm to lock said first and second connector housings relative to each other, locking spring means including a pair of resilient arms mounted at base ends thereof on one of said first and second connector housings and extending obliquely in such a manner as to approach each other, said locking spring means further including a pair of contacting pieces extending from the other ends of said resilient arms and curved in such a manner as to be spaced away from each other, each of said contacting pieces having a lateral extension from an end thereof, and a pair of locking spring engaging means provided on the other of said first and second connector housings and each having a diamond-shaped profile wherein an apex between a pair of outer side inclined faces has a height considerably greater than a height of another apex between a pair of inner side inclined faces from a diagonal line interconnecting the other two apexes, said locking spring engaging means being disposed on loci of said contacting pieces of said locking spring means upon fitting or removal of said first and second connector housings with or from each other such that the diagonal lines are positioned so that, when said first and second connector housings are fitted with each other, said contacting pieces of said locking spring means are guided at said extensions thereof to and by said outer side inclined faces of said locking spring means, but when said first and second connector housings are removed from each other, said contacting pieces are guided to and by said inner side inclined faces of said locking spring means.

2. An electric connector as claimed in claim 1, wherein said locking spring means is a single spring member having a base portion secured to the one of said first and second connector housings, said resilient arms extending from the opposite ends of said base portion.

3. An electric connector as claimed in claim 1, wherein the diagonal lines of said locking spring engaging means are inclined by a small angle with respect to a direction in which said first and second connector housing are inserted into or removed from each other.

* * * * *